US005969468A

United States Patent [19]

Fitzpatrick et al.

[11] Patent Number: 5,969,468

[45] Date of Patent: Oct. 19, 1999

[54] PRESS SEALED LAMP WITH GROOVE FOR LEAD

[75] Inventors: Kenneth C. Fitzpatrick, Peterborough; Walter P. Ziske, Claremont; Michael J. Gregorich, Peterborough, all of N.H.

[73] Assignee: Osram Sylvania Inc., Danvers, Mass.

[21] Appl. No.: 09/153,682

[22] Filed: Sep. 15, 1998

[51] Int. Cl.[6] ..... H01J 5/48; H01J 9/03

[52] U.S. Cl. ..... 313/318.07; 140/71.5; 313/623; 439/619

[58] Field of Search ..... 313/318.07, 623; 140/71.5; 439/619

[56] References Cited

U.S. PATENT DOCUMENTS 3,345,526 10/1967 Wright ..... 313/318
3,829,729 8/1974 Westlund, Jr. et al. ..... 313/318
5,008,588 4/1991 Nakahara ..... 313/318
5,013,961 5/1991 Reedy ..... 313/318

*Primary Examiner*—Sandra O'Shea
*Assistant Examiner*—Ronald E. DelGizzi
*Attorney, Agent, or Firm*—William E. Meyer

[57] ABSTRACT

A press seal-type lamp is provided in the form of a bulb portion and a press seal extending therefrom. The bulb portion contains at least one filament from which extends a first lead wire and a second lead wire. The first and second lead wires are sealed within and extend from the press seal. A length of each lead wire is folded over the press seal and caused to extend into a respective groove formed in the press seal.

18 Claims, 2 Drawing Sheets

PRESS SEALED LAMP WITH GROOVE FOR LEAD

TECHNICAL FIELD

The present invention relates to electric lamps. The electric lamps of the present invention are particularly useful as vehicle interior, dashboard and signal lamps.

BACKGROUND ART

It is known to provide vehicles with press sealed lamps where the contact leads extend from and are folded back over the press seal. For example, it is known to provide such lamps in the form of wedge lamps. One example of a press seal wedge lamp is known generally in the industry as an S-8 . The S-8 is an incandescent light bulb in the form of a generally spherical bulb having a press seal extending therefrom. The bulb contains a filament which is supplied with electricity through two lead wires sealed through the press seal. Similarly, two filament, four lead wire lamps are also commonly made. In a single filament lamp, typically one lead wire extends from the end of the press seal and is folded back over one surface thereof, and a second lead wire extends from the end of the press seal and is folded back over an opposite surface thereof. In use, the press seal is inserted or wedged directly into an electrical socket which contains spreading finger-like contacts which engage respective lead wires to provide mechanical and electrical connection to the lamp. Such lamps are commonly used in automotive interiors, dashboards, signal lamps and the like.

One problem that has occurred during use of press seal lamps is that when the press seal is inserted into the electrical socket, engagement of a lead wire with a finger-like contact sometimes tends to force the lead wire out of alignment. Misalignment may also be undesirably effected as a result of inserting the lamp into the socket at an improper angle or by inadvertently twisting the lamp during insertion. A lead wire which has been displaced tends to cause lamp failure as a result of improper contact between the lead wire and the socket contacts. Such failure may be intermittent or permanent. In addition, a displaced lead wire may provide a lamp which can only be loosely fitted in the socket the result of which is that the lamp tends to fall free. Efforts to reinsert the lamp tend to further bend the lead wire which compounds the problem.

DISCLOSURE OF THE INVENTION

It is an object of the present invention to provide an improved lamp having long life.

Another object of the present invention is to provide a lamp which may be inserted into an electrical socket without causing the lamp lead wires to be displaced from proper alignment.

Yet another object of the present invention is to provide a lamp which when inserted into an electrical socket at an improper insertion angle maintains proper alignment of the lamp lead wires.

A further object of the present invention is to provide a lamp which when twisted during insertion into an electrical socket maintains proper alignment of the lamp lead wires.

Another object of the present invention is to provide an improved press seal-type lamp useful as a vehicle interior lamp, dashboard lamp, signal lamp and the like.

Yet a further object of the present invention is to provide an improved S-8 wedge lamp.

A further object of the present invention is to provide an improved lamp which may be fabricated with existing equipment and processing techniques which have been subjected to minor design and process changes at relatively low cost.

This invention achieves these and other objects by providing a lamp which extends in a first direction of a longitudinal axis from a first end to an opposite second end. The lamp comprises a bulb portion extending in the first direction from the first end towards the second end and a press seal which extends in the first direction from the second end towards the first end. At least one filament is provided within the bulb portion and is electrically connected to a first lead wire and a second lead wire which are sealed within the press seal. The press seal comprises a first groove and a second groove each of which extends in the first direction from the second end towards the first end. The first lead wire and the second lead wire extend from and are folded over the press seal. The first lead wire extends into the first groove, and the second lead wire extends into the second groove.

BRIEF DESCRIPTION OF THE DRAWINGS

This invention may be clearly understood by reference to the attached drawings in which like reference numerals designate like parts and in which.

MODE FOR CARRYING OUT THE INVENTION

Figure 2:
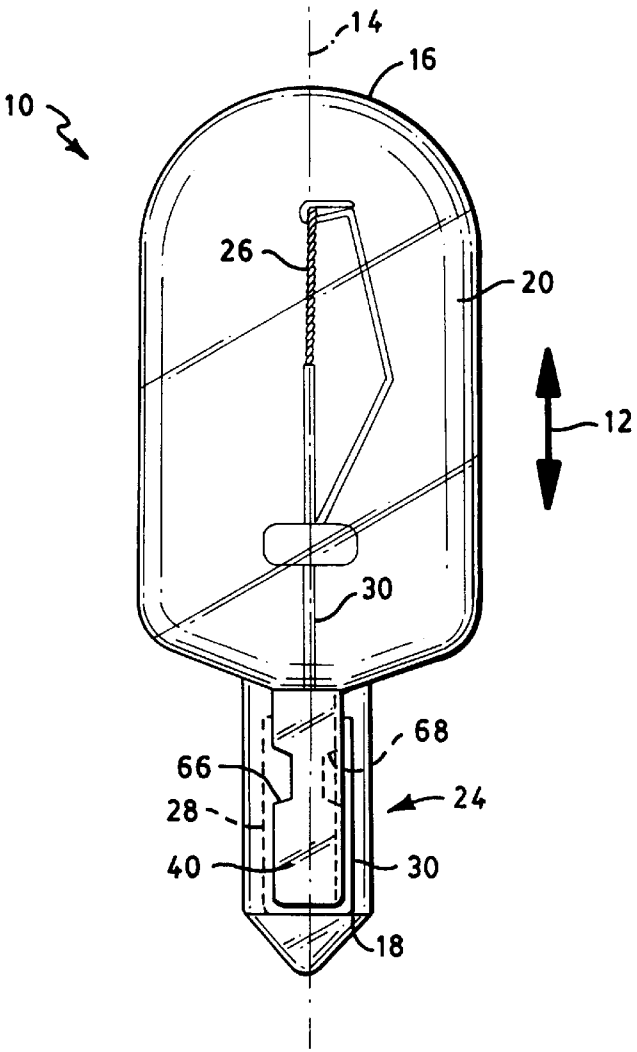
FIG. 2 is a side view of FIG. 1.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention. In the embodiment illustrated in the drawings, a lamp 10 extends in a first direction 12 of a longitudinal axis 14 of the lamp from a first lamp end 16 to an opposite second lamp end 18. In a preferred embodiment, and without limitation, the lamp may be an incandescent press seal lamp known in the industry as an S-8.

The lamp 10 comprises a bulb portion 20 which extends in the direction 12 from lamp end 16 towards lamp end 18. In the embodiment illustrated in the drawings, the bulb portion 20 extends from lamp end 16 to a shoulder 22. Lamp 10 also includes a press seal 24 extending in the direction 12 from the opposite second end 18 towards the first end 16. In the embodiment illustrated in the drawings, the press seal 24 extends from end 18 to the shoulder 22.

The lamp of the present invention may include one or more filaments within the bulb portion, the filament(s) being supplied with electricity through respective lead wires which are sealed through the press seal. For example, a lamp containing one filament will typically include two lead wires, and a lamp containing two filaments will typically include four lead wires, two respective lead wires being electrically connected to each filament.

In the embodiment illustrated in the drawings, the lamp 10 includes one filament 26 within the bulb portions 20. Opposite ends of filament 26 are electrically connected to a first lead wire 28 and a second lead wire 30 in a conventional manner. Lead wires 28 and 30 extend from the bulb portion 20 at the shoulder 22, through the press seal 24, and out of the press seal at end 18 as described hereinafter in more detail. Lead wires 28 and 30 are sealed through the press seal.

The press seal of the present invention includes a first groove and a second groove each of which extends in the direction of the longitudinal axis of the lamp from the second lamp end towards the first lamp end. For example, in the embodiment illustrated in the drawings, the press seal 24 includes a first groove 32 and a second groove 34 which extend in direction 12 from lamp end 18 towards lamp end 16. The grooves 32 and 34 are parallel to the lamp axis. Although not necessary, in the preferred embodiment the grooves 32 and 34 extend from lamp end 18 to the shoulder 22.

In the lamp of the present invention, the lead wires extend from the press seal and are folded over the press seal so that they extend into a groove in the press seal. For example, in the embodiment illustrated in the drawings, lead wire 28 extends from the press seal 24 at end 18 and is folded over the press seal and into the groove 32. Similarly, the lead wire 30 extends from the press seal 24 at end 18 and is folded over the press seal and into the groove 34.

Figure 3:
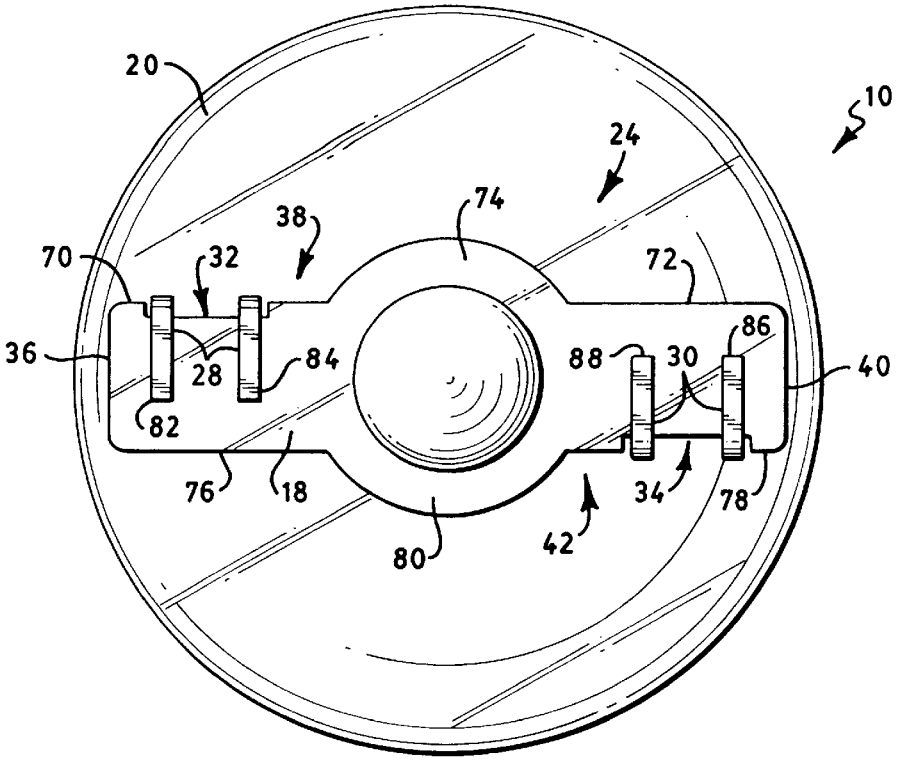
FIG. 3 is a bottom view of FIG. 1.

In the preferred embodiment, a first groove will be provided in a first surface and a second groove will be provided in a second surface, preferably surfaces which are on opposite sides of the press seal. Similarly, in the preferred embodiment a first groove will be disposed adjacent a first edge of the press seal and a second groove will be disposed adjacent an opposite second edge of the press seal. For example, in the embodiment illustrated in the drawings, the groove 32 extends in direction 12 adjacent edge 36 in a first surface 38 of the press seal 24. Similarly, the groove 34 extends in direction 12 adjacent edge 40 in a second surface 42 of the press seal 24. Surfaces 38 and 42 are on opposite sides of the press seal 24, and are best illustrated in FIG. 3.

In considering the use of the lamp 10 described herein, when the lamp end 18 is inserted into a mating electrical socket for electrical and mechanical engagement between the lead wires 28 and 30 and respective conventional finger-like contacts of the socket, the tendency for the lead wires to be displaced by the contact fingers is eliminated. In other words, any tendency for the contact fingers to urge the lead wires out of proper alignment, is eliminated. Nor is there a tendency for the lead wires to be urged out of proper alignment should the lamp be inadvertently inserted into the socket at an improper insertion angle or twisted during insertion. In order to achieve these results, each groove serves to trap a respective lead wire between the opposite walls of the groove thereby preventing sideways motions of the lead wires; that is, motions of the lead wires which are in a direction 44 which is transverse to axis 14. For example, in the preferred embodiment illustrated in the drawings, each groove 32, 34 will be deep enough to trap the wire between opposite groove walls 46, 48 and 50, 52, respectively, yet not so deep so as to prevent contact between the lead wires and a respective contact finger of the socket. In the preferred embodiment, the depth 54 of the grooves 32, 34 will be about 1 to 1.5 times the radius of the lead wire inserted therein. For example, in one embodiment of the lamp 10, lead wires having a diameter 0.012 inch were provided. In this embodiment, the depth 54 was 0.008 inch. Extending the wire lead in each groove to the shoulder 22 further prevents undesirable displacement of the wire leads during insertion of the press seal into the socket. In particular, when each wire lead is positioned in a respective groove and adjacent the shoulder 22, snagging of the end of the lead wire during insertion into the socket will tend to be eliminated.

During production of the lamp of the present invention, the placement of the lead wires and grooves may vary to a certain extent. To accommodate this problem, each groove may be made wider than is geometrically necessary to accommodate a lead wire. For example, in the preferred embodiment, each groove will be wider than the width of the portion of the lead wire which extends into the groove. In particular, when a single linear length of lead wire extends into the groove, the width of the groove, measured in the direction 44, will be greater than the diameter of the lead wire. In some applications, it may be desired to increase the area of contact between each lead wire and the respective contact finger of the socket into which the lamp is inserted. To this end, the length of lead wire inserted into each respective groove may be looped within the groove. For example, in the embodiment illustrated in FIG. 1, the length of each lead wire 28, 30 which is inserted in respective grooves 32 and 34 is looped as explained hereinafter in more detail. When the lead wire inserted into the groove is in the configuration of a loop, as illustrated in FIG. 1, the width of the groove will be greater than the width of the loop.

Figure 4:
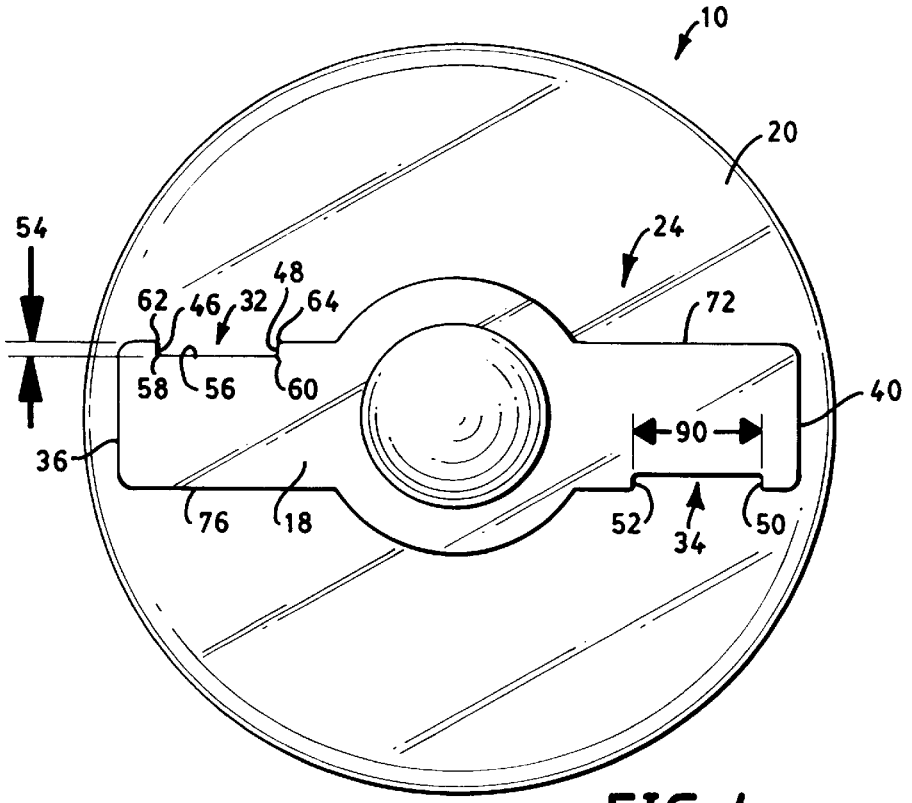
FIG. 4 is an enlarged view of FIG. 3 with the lead wires removed for clarity.

In conventional lamps having press seals, the press seal tends to have residual stresses. As a result, any chips or other irregularities, or the use of too much force when inserting the lamp into a mating socket, may cause cracking of the press seal thereby causing lamp failure. Sharp corners are particularly subject to fracture initiation and add to this problem. In order to prevent this from happening, the edges and corners of the groove(s) in the press seal of the present invention may be provided with a radius or otherwise rounded. In this manner, sharp corners are eliminated from the boundaries of the grooves thereby reducing the tendency for the lamp press seal to crack. For example, in the embodiment illustrated in the drawings, each groove 32, 34 includes corners and edges which are rounded. In particular, with reference to FIG. 4, the opposite walls 46, 48 of groove 32 extend from a groove base 56 at respective base junctions 58, 60, to respective distal edges 62, 64. Each base junction 58, 60 is rounded in a concave configuration, and each distal edge 62, 64 is rounded in a convex configuration. Groove 34 is identical to groove 32.

The lamp of the present invention may include one or more transverse slots in the press seal which provide an indented area into which a portion of the finger-like contacts of a conventional electrical socket may extend to provide a latching effect between the socket and the lamp inserted therein. Such slots may also provide contact point pressure relief between the finger-like contacts and the press seal. For example, the press seal 24 of the lamp 10 illustrated in the drawings includes a first slot 66 in the surface 38 and a second slot 68 in the surface 42, slots 66 and 68 extending in the direction 44 which is transverse to the longitudinal axis 14 of the lamp. Slot 66 extends from edge 40 towards groove 32, and slot 68 extends from edge 36 towards groove 34. To this end, in the embodiment illustrated in the drawings, the surface 38 includes a portion 70 which extends from the edge 36 towards the edge 40, and another portion 72 which extends from the edge 40 towards the edge 36. Portions 70 and 72 meet at a central portion 74 of the lamp exhaust tube. The surface portion 70 includes the groove 32, and the surface portion 72 includes the slot 66. Similarly, the surface 42 includes a portion 76 which extends from the edge 36 towards the edge 40 and another portion 78 which extends from the edge 40 towards the edge 36. Portions 76 and 78 meet at a central portion 80 of the lamp exhaust tube. The surface portion 76 includes the slot 68, and the surface portion 78 includes the groove 34.

Figure 1:
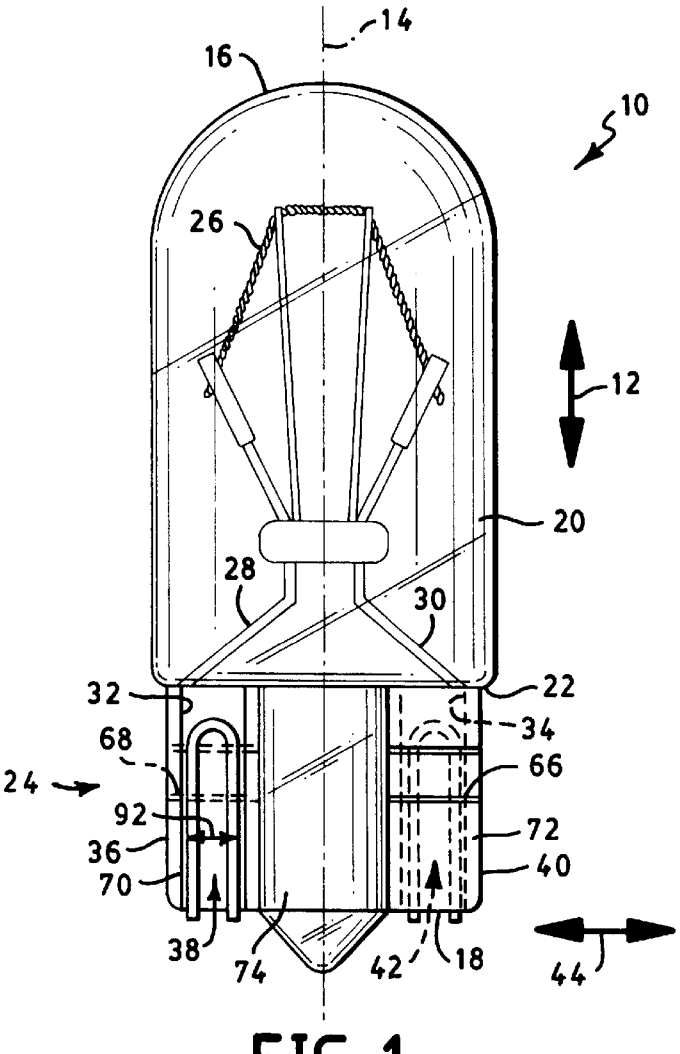
FIG. 1 is a front view of one embodiment of a lamp of the present invention.

In considering the configuration of the looped lead wires vis-a-vis the press seal longitudinal grooves and transverse slots, and referring to FIGS. 1 and 3, a length of the lead wire 28 extends from the press seal at end 18 at a position 82 which is between surface portions 70 and 76. Such length of lead wire 28 is folded over the surface portion 70 and looped in the groove 32, a distal end segment of the lead wire being folded back over the end 18 and inserted a short distance back into the press seal 24 at position 84. Similarly, a length of lead wire 30 extends from the press seal at end 18 at a position 86 which is between surface portions 72 and 78. Such length of lead wire 30 is folded over the surface portion 78 and looped in the groove 34, a distal end segment of the lead wire being folded back over the end 18 and inserted a short distance back into press seal 24 at position 88. The transverse width 90 of each groove 32, 34 is greater than the overall width 92 of the loop formed by lead wires 28 and 30 in respective grooves 32, 34.

Fabrication of the lamp of the present invention may be accomplished with minimum alteration of conventional press tools typically used in the manufacture of, for example, an S-8 lamp. The cost to modify tooling to produce the lamp of the present invention is therefore relatively low. For example, a conventional sealer may be modified by machining an area of an existing front and rear press tool to provide an area which will form the desired grooves during the fabrication of the press seal during the conventional pressing operation. In a preferred embodiment, the front and rear press tools may be machined to provide pressing surfaces which cooperate during the formation of the press seal to provide grooves having a depth 54 of 0.008 inch, a width 90 of 0.072 inch and rounded base junctions 58, 60 and distal edges 62, 64 each having a radius of 0.006 inch. Such a press seal is particularly useful when the diameter of each lead wire 28, 30 is 0.012 inch and each lead wire is looped in a respective groove 32, 34 as illustrated in FIG. 1.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A press seal lamp extending in a first direction of a longitudinal axis from a first end towards an opposite second end, comprising, a bulb portion extending in said first direction from said first end towards said second end and a press seal extending in said first direction from said second end towards said first end, at least one filament within said bulb portion, said at least one filament electrically connected to a first lead wire and a second lead wire, said first lead and said second lead extending from inside said bulb through said press seal, said press seal including an exterior surface formed with a first groove and a second groove, each groove extending in said first direction from said second end towards said first end, said first lead wire and said second lead wire extending from said press seal and being folded over said press seal, said first lead wire extending in said first groove, and said second lead wire extending in said second groove.

2. The lamp of claim 1 wherein said first groove extends in said first direction from said second end towards said first end in a first surface of said press seal, and said second groove extends in said first direction from said second end towards said first end in an opposite second surface of said press seal.

3. The lamp of claim 2 wherein said first groove extends in said first direction adjacent a first edge of said press seal, and said second groove extends in said first direction adjacent an opposite second edge of said press seal.

4. The lamp of claim 3 wherein said first lead wire is looped within said first groove and said second lead wire is looped within said second groove.

5. The lamp of claim 2 further including a first slot in said first surface and a second slot in said second surface, said first slot and said second slot extending in a second direction transverse to said longitudinal axis.

6. The press seal of claim 3 further including a first slot in said first surface and a second slot in said second surface, said first slot and said second slot extending in a second direction transverse to said longitudinal axis, said first slot extending from said second edge towards said first groove, and said second slot extending from said first edge towards said second groove.

7. The lamp of claim 6 wherein said first lead wire is looped within said first groove and said second lead wire is looped within said second groove.

8. The press seal of claim 1 wherein said first and second groove each comprises opposite walls each of which extends from a groove base, at a respective base junction, to a respective distal edge, each base junction being rounded in a concave configuration and each distal edge being rounded in a convex configuration.

9. The press seal of claim 6 wherein said first and second groove each comprises opposite walls each of which extends from a groove base, at a respective base junction, to a respective distal edge, each base junction being rounded in a concave configuration and each distal edge being rounded in a convex configuration.

10. A press seal lamp, comprising, a bulb portion extending in a first direction of a longitudinal axis from a first lamp end to a shoulder; a press seal extending in said first direction from an opposite second lamp end to said shoulder, said press seal including a first groove and a second groove each extending in said first direction from said second lamp end to said shoulder; at least one filament within said bulb portion; and a first lead wire and a second lead wire each electrically connected to said at least one filament, sealed in said press seal, and having a length extending from said press seal at said second lamp end, said length of said first lead wire being folded over said second lamp end and extended into said first groove, and said length of said second lead wire being folded over said second lamp end and extended into said second groove.

11. The press seal lamp of claim 10 wherein said first groove extends in said first direction from said second end towards said first end in a first surface of said press seal, and said second groove extends in said first direction from said second end towards said first end in an opposite second surface of said press seal.

12. The press seal lamp of claim 11 wherein said first groove extends in said first direction adjacent a first edge of said press seal, and said second groove extends in said first direction adjacent an opposite second edge of said press seal.

13. The press seal lamp of claim 12 wherein said first lead wire is looped within said first groove and said second lead wire is looped within said second groove.

14. The press seal lamp of claim 13 further including a first slot in said first surface and a second slot in said second surface, said first slot and said second slot extending in a second direction transverse to said longitudinal axis, said first slot extending from said second edge towards said first groove, and said second slot extending from said first edge towards said second groove.

15. A press seal lamp, comprising, a bulb portion extending in a first direction of a longitudinal axis from a first end towards an opposite second end; a press seal extending in said first direction from said second end towards said bulb portion, said press seal including a first surface and an opposite second surface; said first surface including a first portion extending from a first edge of said press seal towards an opposite second edge of said press seal, and an opposite second portion extending from said second edge towards said first edge, said first portion comprising a first groove extending in said first direction; said second surface including a third portion extending from said first edge towards said second edge and an opposite fourth portion extending from said second edge towards said first edge, said fourth portion comprising a second groove extending in said first direction;

at least one filament within said bulb portion; and a first lead wire and a second lead wire each electrically connected to said least one filament and extending in said first direction through said press seal, said first lead wire including a first length extending from said press seal at said second end between said first surface portion and said third surface portion, said first length being folded over first surface portion and extended into said first groove, and said second lead wire including a second length extending from said press seal at said second end between said second surface portion and said fourth surface portion, said second length being folded over said fourth surface portion and extended into said second groove.

16. The press seal lamp of claim 15 wherein said first length is looped within said first groove and said second length is looped within said second groove.

17. The press seal lamp of claim 16 wherein said first length and said second length each includes a distal end segment which is inserted back into said press seal at said second end.

18. The press seal lamp of claim 16 wherein said second portion includes a first slot, and said third portion includes a second slot, said first slot and said second slot extending in a second direction which is transverse to said longitudinal axis.

* * * * *